United States Patent [19]

Chu

[11] 4,218,808

[45] Aug. 26, 1980

[54] HINGE HAVING REPRODUCIBLE BEARING FRICTION

[75] Inventor: Pak-Jong Chu, Ottawa, Canada

[73] Assignee: Northern Telecom Limited, Montreal, Canada

[21] Appl. No.: 9,844

[22] Filed: Feb. 6, 1979

[51] Int. Cl.[3] ..... E05D 11/08

[52] U.S. Cl. ..... 16/141; 16/168; 220/342

[58] Field of Search ..... 16/140, 128 R, 141, 16/168, 169; 220/342, 343

[56] References Cited

U.S. PATENT DOCUMENTS

| | | | |
|---|---|---|---|
| 2,349,802 | 5/1944 | McKnight | 220/343 |
| 2,901,753 | 9/1959 | Sperzel | 16/140 X |
| 3,037,236 | 6/1962 | Miller | 16/140 |
| 3,239,874 | 3/1966 | Sperzel | 16/140 |

FOREIGN PATENT DOCUMENTS

| | | | |
|---|---|---|---|
| 680031 | 10/1952 | United Kingdom | 16/140 |
| 1245573 | 9/1971 | United Kingdom | 16/140 |

*Primary Examiner*—Andrew V. Kundrat
*Attorney, Agent, or Firm*—Sidney T. Jelly

[57] ABSTRACT

Two rigid bodies are hinged together by a pair of elastomer hinge elements each of which is fixed within one body and rotatably mounted relative to the other body. At the rotary mounting, the elastomer material is stressed by interengagement with the other body to produce reproducible bearing friction. Properties of the elastomer material are selected to adapt the material for the hinge function; the elastomer element is readily replaceable without the need to replace the rigid bodies.

9 Claims, 3 Drawing Figures

HINGE HAVING REPRODUCIBLE BEARING FRICTION

This invention relates to hinges, particularly to hinges which provide a reproducible bearing friction between hinged bodies. A hinge according to the invention has a specific application in repertory dial telephone sets for hinging a lid relative to the base of a telephone set, the lid covering a list of repertory numbers.

In operating a repertory dialler telephone set in its repertory mode, three functions must be performed: the number to be called and its repertory abbreviation must be looked up, the telephone handset lifted and the repertory abbreviation number dialled. Clearly it is time saving and convenient to perform these actions simultaneously and at one location. With the latter in mind, a repertory dialler telephone set has been designed in which a list of regularly dialled numbers and their repertory abbreviation numbers can be displayed at the upper surface of the instrument where a keypad is also accessible. However, the list of numbers can give a cluttered appearance to the instrument facia and detract from its aesthetic appearance. This problem is overcome by using a hinged lid made in the same rigid plastics material as the telephone instrument base. Incorporation of the lid results, unfortunately, in a further problem in that the caller really needs three hands: one hand to hold the handset, one hand to hold the lid open so that the repertory coding list can be inspected and a third hand to dial the appropriate number. One solution to this problem is to incorporate sufficient friction in the hinge that the cover will remain in in any position to which it is lifted.

To further adapt a hinge to this specific application, an additional requirement is that the hinged lid should be cheaply and easily manufactured and assembled. This precludes relatively sophisticated friction hinges such as that shown in U.S. Pat. No. 3,837,042 in which a frusto-conical plastic block is frictionally engaged within a correspondingly-shaped recess in a first rigid member and screw means fixed to a second rigid member are provided to draw the block into the recess to increase the resistance to turning of the block within the recess.

A simple hinge design for this specific application has a rigid plastics cover moulded with a pair of opposed, coaxial pins and an instrument base moulded with a pair of coaxial bores or recesses to receive the pins; (alternatively the pins could be on the base and the bores on the cover). Since the hinged parts are moulded in a comparatively rigid plastics, the pin-hole engagement tends either to be too tight or too loose unless the pin and hole are made to an extremely low tolerance specification. In addition, repeated frictional engagement between the rigid plastics surfaces causes wear and loosening of the hinge bearing with eventual fracture of the pin or of material defining the bore.

A hinge suitable for this application is provided by the invention which, in its broadest aspect, comprises a pair of bodies of rigid material and an elastomer hinge member fixedly mounted relative to one of the bodies and rotatably mounted relative to the other body to hinge the bodies together, the elastomer material being stressed by interengagement of the elastomer member and said other member at the rotary mounting, thereby to produce a friction bearing. The elastomer material may for example be one of silicon rubber, urethane and polyester. The elastomer can have a cylindrical pin frictionally located within an undersized bore in said other body so as to compress the elastomer material. Alternatively, the elastomer member has an undersized bore to frictionally receive a pin extending from said other body so as to stretch the elastomer material.

The elastomer member is preferably moulded to have a base part integral with the pin, the base part being engageable within a housing in said one body. Preferably one dimension of said housing is undersized relative to the corresponding dimension of the base part. In this way, the elastomer member can be distorted to provide frictional engagement between the member and said one body.

Preferably a surface of the elastomer member from which the cylindrical pin projects protrudes from the housing and faces a surface of said other body into which said bore extends, the hinge further including a means for pressing the elastomer member and the other body together so that said surfaces frictionally engage. One of the surfaces can be matt to enhance frictional engagement; similarly, one of the mating surfaces of said pin and bore can also be matt.

In another aspect of the invention, the hinge can include a second elastomer hinge member similarly mounted between said pair of bodies, the rotary mountings being coaxial and said other body member being resiliently clamped between opposed parts of said one body by said elastomer hinge members.

In another aspect of the invention, an instrument, incorporating a hinge as hereinbefore defined, has a cover part of an instrument base comprising said one body, and a lid comprising the other body, said cover part having a pair of upwardly projecting flanges between which said cover plate is hinged, each of said flanges having a chamber, elastomer members being fixed within and protruding from respective chambers. The cover plate can have a relatively thicker region at each rotary mounting, the base having a part cut-away to accommodate rotary movement of said thicker regions.

An embodiment of the invention will now be described by way of example with reference to the accompanying drawings in which.

Figure 1:
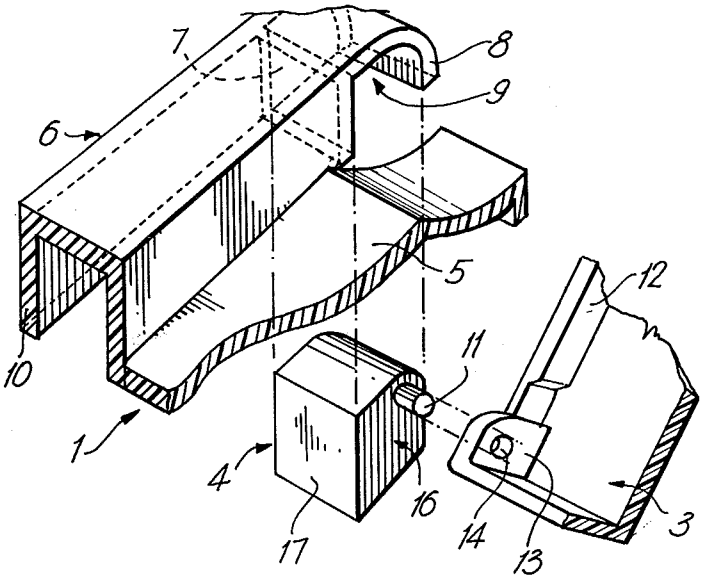
FIG. 1 is a perspective, exploded view of part of a telephone set incorporating a hinge according to the invention.

Referring in detail to the FIG. 1, there are shown vertically disposed parts of several elements of a repertory dialler telephone set. Cover 1 fits over an instrument base 2, (FIG. 3), a lid 3 being hinged to the cover 1 by a pair of hinge elements 4 of which one is shown.

The cover 1, base 2 and lid 3 are all moulded in rigid plastics. Hinge element 4 is moulded in an appreciably more resilient elastomeric material; for example, silicon rubber, urethane or polyester. Typically the elastomeric material has a shore "A" durometer hardness of 60 to 90, rebound impact resilience in the range 30–40%, tensile strength in the range 4000 to 7000 p.s.i. and "C" die tear strength in the range 500 to 700 p.s.i.

Figure 2:
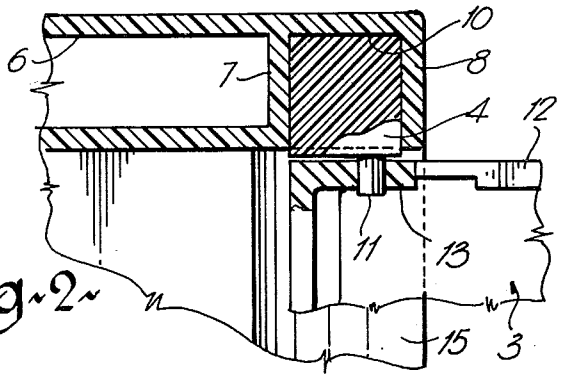
FIG. 2 is a part-sectional view of the assembled hinge.

The base 2 would normally house transducers, signalling circuitry and logic circuitry for affording a repertory function. In a repertory mode, several frequency dialled multi-digit numbers are stored; any of the numbers can be accessed and appropriate signalling sent to the central office using a one-or two-digit code. It is convenient to have a list of multi-digit numbers and their corresponding codes displayed on the telephone instrument, but, since the list is not referred to for every call, and to preserve the aesthetic appearance of the set, the number listing, which appears on an upper surface 5 of the cover 1, is normally covered by the hinged lid 3. The upper surface 5 extends between box-form flanges 6, the outer side surfaces of which, as shown in FIG. 2, extend flush with the sides of the base 2. At the rearward end of each flange 6, a compartment for housing the hinge element 4 is defined on one side by an internal wall 7 and at the opposite side by a curved rear wall 8 which is best shown in FIG. 1. A base part 17 of the hinge element is cuboid over its lower part and has an upper part matching the contour of the rear wall 8. The base part 17, which is a press fit within the compartment 9, is confined at its outer surface by an outer wall 10 of the flange 6. Each hinge element 4 has a cylindrical pin 11, the pins of the two elements when press fitted into place being coaxial and opposed. As shown in FIG. 2, an inner surface of the hinge element at the base of the pin 11 protrudes a short distance, of the order of 0.01", beyond the inner surface of flange 6. The lid 3 is rectangular and has flanges 12 which, when the lid is covering the display region, so space the lid from the surface of the cover 1 that the upper surface of the lid 3 is flush with the upper surfaces of flanges 6. The lid has thickened regions 13, in each of which is formed a bore 14 to receive one of the pins 11 in a friction fit. To this end, in the particular example shown, the elastomer pin is moulded with an unstressed diameter of 0.13" while the hole is moulded to a diameter of 0.0125".

Figure 3:
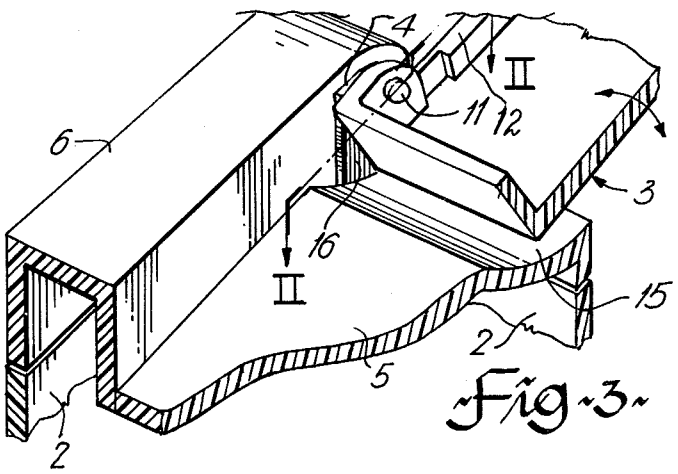
FIG. 3 is a perspective view of the assembled hinge.

As best shown in FIG. 3, the rear upper corner of the cover 1 is bevelled, the bevel being curved to permit the rear edge of the lid to rotate about an axis close to the plane of the cover upper surface.

The hinge provides appreciable, reproducible bearing friction to ensure that when the lid is moved to any of a range of positions, it will remain there without needing to be held. The hinge is particularly adapted to a repertory dialler telephone set since a caller typically wishes to hold the telephone handset with one hand and to dial a number with the other hand. Having lifted the lid 3 to expose the display region 5, the caller would find it very inconvenient to have to hold the lid in its open position.

Bearing friction is obtained firstly, at the interface of each of pins 11 and its corresponding bore 14, and secondly at the interface between hinge element surfaces 16 which protrude beyond the inner surfaces of flanges 6 and press against outer surfaces of the thickened regions 13, the lid 3 thus, in effect, being squeezed between the two hinge elements 4. To enhance friction between the bearing surfaces of the elastomer hinge element 4 and/or the lid 3 can be moulded with a matt finish.

An advantage of using the simple elastomer hinge element is that if hinge operation does deteriorate, the element can be cheaply replaced, the original lid and cover being retained.

It will be understood that friction in the hinge can be altered by altering the area of friction engagement between the hinge element and the lid. In an alternative embodiment of the invention (not shown), the hinge element is formed with a cylindrical recess and the lid 3 is moulded with pins.

In the specific application to a repertory dialler telephone set, it is preferable that if the lid 3 is so close to the closed position that the code listing on the display region 5 cannot easily be viewed, then the lid should automatically return to the fully closed position to restore the aesthetic appearance of the telephone set. This can be achieved once a set orientation of the instrument is determined by appropriately relating the moment or couple of the lid weight about its axis of rotation to the hinge bearing friction.

What is claimed is:

1. A hinge comprising first and second rigid bodies and a pair of spaced elastomer hinge members, the hinge members each having a base portion located within and having an oversize dimension relative to respective housings in the first body whereby to retain the hinge members therein, the hinge members and the second body having opposed surfaces at each of a pair of coaxial rotary mountings, the spacing from one another of the opposed surfaces of the hinge members, with the elastomers unstressed, being different from the spacing of the opposed surfaces of said second body whereby the elastomer is stressed in use to produce bearing friction, each of said mountings being provided by a first cylindrical formation extending from the opposed surface of the hinge element engaging a second cylindrical formation extending from the opposed surface of the second body, the formations being differently sized thereby naturally stressing the elastomer to produce additional bearing friction.

2. A hinge as claimed in claim 1 in which the hinge member cylindrical formation is a cylindrical projection and the cylindrical formation in the second body is a relatively undersized bore to compress said elastomer material.

3. A hinge as claimed in claim 2, in which one of the bearing surfaces of said cylindrical formations is matt to enhance frictional engagement therebetween.

4. A hinge as claimed in claim 2 in which said bore is tapered.

5. A hinge as claimed in claim 1, in which one of said opposed surfaces is matt.

6. An instrument incorporating a hinge as claimed in claim 1, said first body comprising a cover part of an instrument base, the second body comprising a lid, said cover part having a pair of outwardly projecting flanges between which flanges said lid is hinged, the housings being formed within said flanges.

7. An instrument as claimed in claim 6, said lid having relatively thicker regions at said rotary mountings, said cover part having a curved recess to accommodate rotary movement of said thicker regions.

8. An instrument as claimed in claim 7, the lid being moveable through a range of open positions to a closed position in which an upper surface of the lid is flush with upper surfaces of said flanges.

9. An instrument as claimed in claim 8 in which, at a predetermined angle of the lid to the horizontal, the moment of the lid weight, acting about the axis of rotation, exceeds friction within the hinge and the lid drops to said closed position.

* * * * *